US010825402B2

(12) United States Patent
Huang

(10) Patent No.: US 10,825,402 B2
(45) Date of Patent: Nov. 3, 2020

(54) DISPLAY APPARATUS AND DRIVING METHOD THEREFOR

(71) Applicants: HKC Corporation Limited, Shenzhen, Guangdong (CN); Chongqing HKC Optoelectronics Technology Co., Ltd., Chongqing (CN)

(72) Inventor: Xiaoyu Huang, Chongqing (CN)

(73) Assignees: HKC Corporation Limited, Shenzhen, Guangdong (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/329,158

(22) PCT Filed: Jun. 28, 2018

(86) PCT No.: PCT/CN2018/093373

§ 371 (c)(1),
(2) Date: Feb. 27, 2019

(87) PCT Pub. No.: WO2019/184115

PCT Pub. Date: Oct. 3, 2019

(65) Prior Publication Data

US 2020/0013350 A1 Jan. 9, 2020

(30) Foreign Application Priority Data

Mar. 28, 2018 (CN) ..... 2018 1 0264696

(51) Int. Cl.
*G09G 3/30* (2006.01)
*G09G 3/36* (2006.01)
*G09G 3/34* (2006.01)

(52) U.S. Cl.
CPC ..... *G09G 3/3413* (2013.01); *G09G 3/3696* (2013.01); *G09G 2320/064* (2013.01)

(58) Field of Classification Search
CPC . G09G 3/006; G09G 2310/0243–0297; G09G 3/30–38
See application file for complete search history.

(56) References Cited

U.S. PATENT DOCUMENTS

2008/0284720 A1* 11/2008 Fukutome ..... G09G 3/3406 345/102
2014/0267444 A1* 9/2014 Hwang ..... G09G 3/3225 345/690

(Continued)

FOREIGN PATENT DOCUMENTS

CN 101388195 A 3/2009
CN 101389177 A 3/2009

(Continued)

*Primary Examiner* — Sanghyuk Park
(74) *Attorney, Agent, or Firm* — Muncy, Geissler, Olds & Lowe, P.C.

(57) ABSTRACT

This application provides a display apparatus and a driving method therefor. The display apparatus includes: a storage module, configured to provide display data; a timing controller, configured to: read the display data, convert the display data to image data, and output the image data and a control signal; a brightness adjusting module, configured to adjust a working state of the brightness adjusting module according to the control signal; and a display module, configured to receive the image data output by the timing controller and present a corresponding image, where after finishing configuring the image data of the display module and receiving a feedback signal sent by the display module, the timing controller controls the brightness adjusting module to be turned on, and the brightness adjusting module is connected to the timing controller by using a spring and a probe of a fan-out area.

20 Claims, 7 Drawing Sheets

(56) References Cited

U.S. PATENT DOCUMENTS

| | | | | |
|---|---|---|---|---|
| 2015/0187246 | A1* | 7/2015 | Yoshizawa | G09G 3/18 345/207 |
| 2019/0064217 | A1* | 2/2019 | Pu | G01R 1/06722 |

FOREIGN PATENT DOCUMENTS

| | | | |
|---|---|---|---|
| CN | 102737602 | A | 10/2012 |
| CN | 102810298 | A | 12/2012 |
| KR | 10-2012-0023233 | A | 3/2012 |
| KR | 10-1143602 | B1 | 5/2012 |

* cited by examiner

DISPLAY APPARATUS AND DRIVING METHOD THEREFOR

BACKGROUND

Technical Field

This application relates to the display field, and in particular, to a display apparatus and a driving method therefor.

Related Art

A thin film transistor display apparatus (TFT-LCD, Thin Film Transistor Liquid Crystal Display) is one of the main types of current flat display apparatuses and has become an important display platform of modern IT and video products. A main principle for driving the thin film transistor display apparatus is that a system board connects an R/G/B compression signal, a control signal and power to a connector on a printed circuit board (PCB) by using a wire. After data is processed by a timing controller (TCON) on the PCB, the data passes through the PCB and is connected to a display area by using a source-chip on film (S-COF) and a gate-chip on film (G-COF), so that the display apparatus obtains required power and signals.

During actual application of the display apparatus, in a turn-on process of the display apparatus, data of the timing controller stored in an external storage medium needs to be completely read, and after voltages in the timing controller such as a scanning voltage and a data voltage are completely stable, that is, after a power-on time of the timing controller, the brightness adjusting module is turned on to provide a corresponding light source. In this way, a possible abnormal image can be prevented from being viewed by a viewer. The power-on time is determined based on experiments or experience of manufacturers. However, such a design has a problem. When the timing controller is abnormal, making the power-on time of the timing controller prolonged, an abnormal image of the display apparatus is likely to be viewed by a viewer.

SUMMARY

To resolve the foregoing technical problem, the objectives of this application are to provide a display apparatus and a driving method therefor, so as to ensure that a brightness adjusting module is turned on after preparations of a timing controller are finished. This can prevent, when abnormality occurs, an abnormal image from being viewed by a viewer due to that a preparation time of the timing controller is longer than a preset value.

The objectives of this application are achieved and the technical problem of this application is resolved by using the following technical solutions. A display apparatus according to this application comprises: a storage module, configured to provide display data; a timing controller, configured to: convert the display data to image data, and output the image data and a control signal; a brightness adjusting module, configured to adjust a working state of the brightness adjusting module according to the control signal; and a display module, configured to receive the image data output by the timing controller and present a corresponding image, where the brightness adjusting module is connected to the timing controller by using a spring and a probe of a fan-out area; and after finishing configuring the image data of the display module and receiving a feedback signal sent by the display module, the timing controller controls the brightness adjusting module to be adjusted from an off working state to an on working state.

In an embodiment of this application, the spring and a part of the probe are arranged within a base, where the spring, the probe and the base are arranged in a front frame of the display apparatus.

In an embodiment of this application, the brightness adjusting module detects a potential status of the control signal by using the probe.

In an embodiment of this application, potentials of the control signal and potentials of the feedback signal each comprise a high potential and a low potential, and the control signal and the feedback signal are square wave signals, triangular wave signals or sine wave signals.

In an embodiment of this application, when the control signal received by the brightness adjusting module is at a high potential, the brightness adjusting module is in the on working state.

In an embodiment of this application, when the control signal received by the brightness adjusting module is at a low potential, the brightness adjusting module is in the off working state.

In an embodiment of this application, the probe is made of a metal material, and may be, for example, made of copper and a copper alloy material.

Further, the objectives of this application may be achieved and the technical problem of this application may be resolved by using the following technical solutions.

Another objective of this application is to provide a method for driving a display apparatus. The method comprises: powering on the display apparatus; reading, by a timing controller, display data in a storage module, converting the display data to image data, and outputting the image data and a control signal; receiving, by a display module, the image data, and presenting a corresponding image; receiving, by a brightness adjusting module, the control signal, and adjusting a working state of the brightness adjusting module according to the control signal; and after finishing configuring the image data of the display module and receiving a feedback signal sent by the display module, controlling, by the timing controller, the brightness adjusting module to be adjusted from an off working state to an on working state.

In an embodiment of this application, potentials of the control signal and potentials of the feedback signal each comprise a high potential and a low potential, where the control signal and the feedback signal are square wave signals, triangular wave signals or sine wave signals.

In an embodiment of this application, when the control signal received by the brightness adjusting module is at a high potential, the brightness adjusting module is in the on working state.

In an embodiment of this application, when the control signal received by the brightness adjusting module is at a low potential, the brightness adjusting module is in the off working state.

Still another objective of this application is to provide a display apparatus. The display apparatus comprises: a storage module, configured to provide display data; a timing controller, configured to: read the display data, convert the display data to image data, and output the image data and a control signal, where potentials of the control signal and potentials of the feedback signal each comprise a high potential and a low potential, and the control signal and the feedback signal are square wave signals; a brightness adjusting module, configured to adjust a working state of the brightness adjusting module according to the control signal;

and a display module, configured to receive the image data output by the timing controller and present a corresponding image, where after finishing configuring the image data of the display module and receiving a feedback signal sent by the display module, the timing controller outputs a high-potential square wave signal to the brightness adjusting module by using a source-chip on film and a fan-out area, and controls the brightness adjusting module to be adjusted from an off working state to an on working state.

By using the design of the display apparatus and the driving method therefor of this application, it can be ensured that the brightness adjusting module is turned on after preparations of the timing controller are finished. This can prevent, when abnormality occurs, an abnormal image from being viewed by a viewer due to that a preparation time of the timing controller is longer than a preset value.

DETAILED DESCRIPTION

The following embodiments are described with reference to the accompanying drawings, which are used to exemplify specific embodiments for implementation of this application. Terms about directions mentioned in this application, such as "on", "below", "front", "back", "left", "right", "in", "out", and "side surface" merely refer to directions in the accompanying drawings. Therefore, the used terms about directions are used to describe and understand this application, and are not intended to limit this application.

The accompanying drawings and the description are considered to be essentially exemplary, rather than limitative. In the figures, units with similar structures are represented by using the same reference number. In addition, for understanding and ease of description, the size and the thickness of each component shown in the accompanying drawings are arbitrarily shown, but this application is not limited thereto.

In addition, throughout this specification, unless otherwise explicitly described to have an opposite meaning, the word "include" is understood as including the component, but not excluding any other component. In addition, throughout the specification, "on" means that one is located above or below a target component and does not necessarily mean that one is located on the top based on a gravity direction.

To further describe the technical measures taken in this application to achieve the intended application objectives and effects thereof, specific implementations, structures, features, and effects of a display apparatus and a driving method therefor that are provided according to this application are described below in detail with reference to the drawings and specific embodiments.

Figure 1:
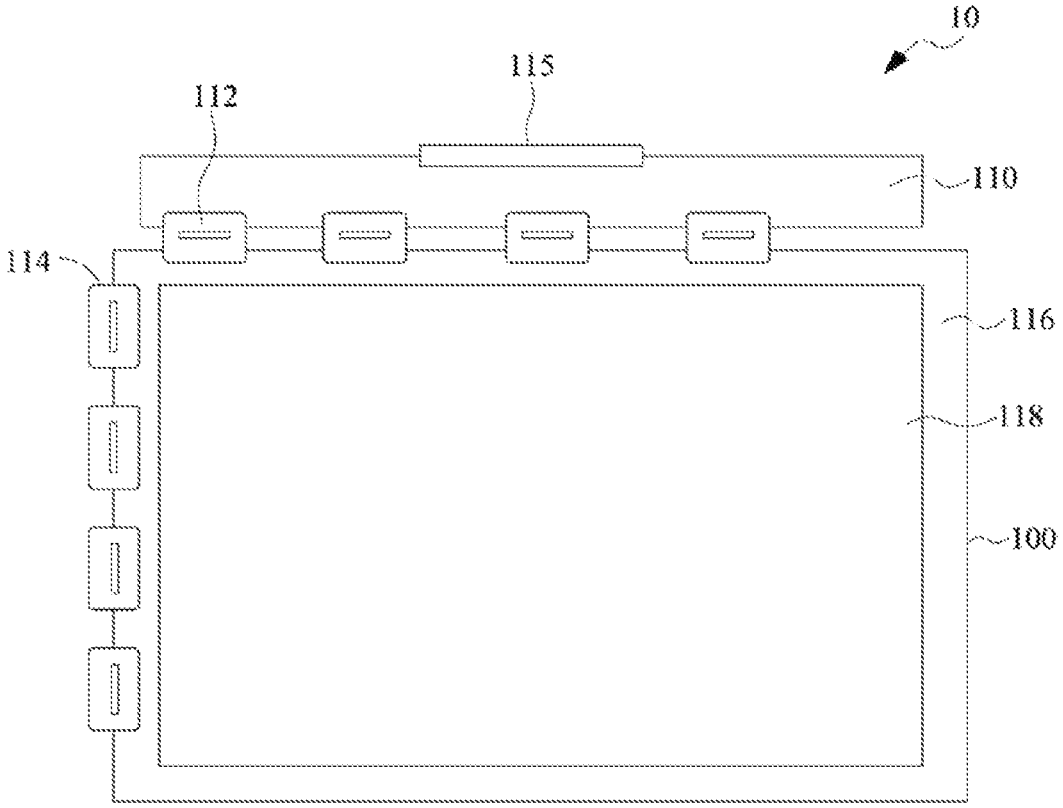
FIG. 1 is a schematic diagram of an exemplary display apparatus.

FIG. 1 is a schematic diagram of an exemplary display apparatus. Referring to FIG. 1, the exemplary display apparatus 10 includes: a printed circuit board (PCB) 110, including a connector 115; a timing controller (not shown); a display panel 100, where the display panel 100 includes a display area 118 and a wiring area 116; a plurality of source-chip on films 112 and a plurality of gate-chip on films 114 arranged relative to each other on the wiring area 116 of the display panel 100; and a brightness adjusting module (not shown), providing a required light source to the display panel 100 for displaying. The brightness adjusting module of the display apparatus 10 is turned on after a power-on time during which the configuration of a voltage parameter of the timing controller has been finished.

A power-on time for delaying turning on of the brightness adjusting module of the display apparatus 10 depends on experiments or experience of each manufacturer, and there are differences between power-on times of different manufacturers. However, according to such a design, when the timing controller is abnormal, that is, when data is not completely read or voltages in the timing controller such as a scanning voltage and a data voltage are not completely stable, a power-on time of the timing controller is correspondingly prolonged, while the brightness adjusting module is automatically turned on after a preset time period. In this case, a time point at which the brightness adjusting module is turned on is before a power-on time during which preparations of the timing controller are finished. As a result, an abnormal image of the display apparatus 10 is likely to be viewed by a viewer, affecting viewing experience.

Figure 2:
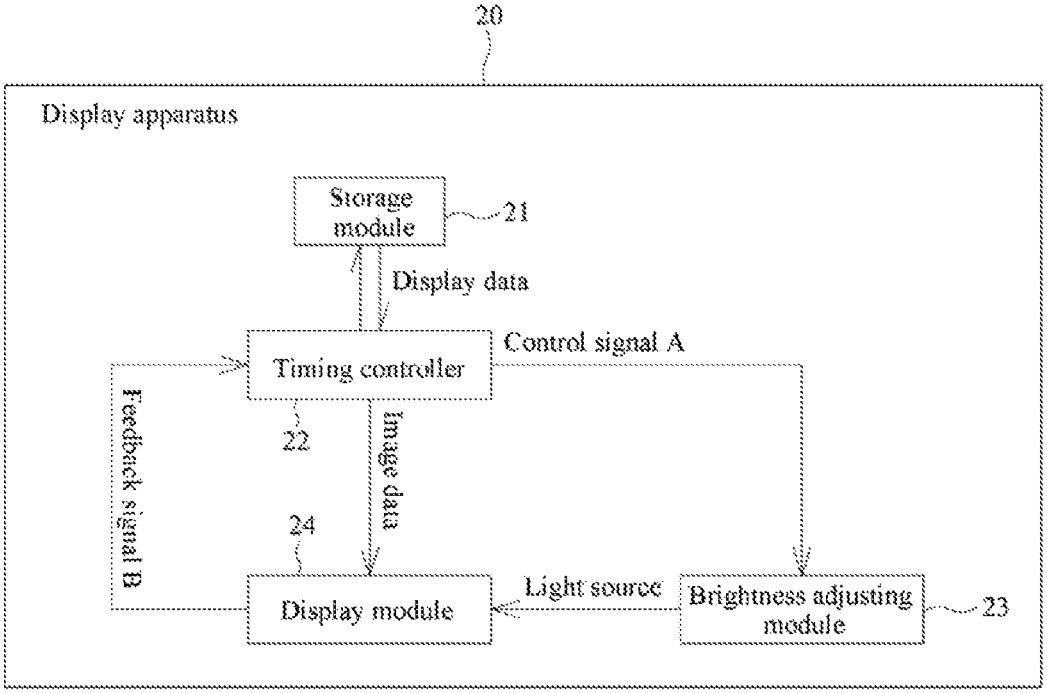
FIG. 2 is a schematic diagram of a display apparatus according to an embodiment of this application.
Figure 3:
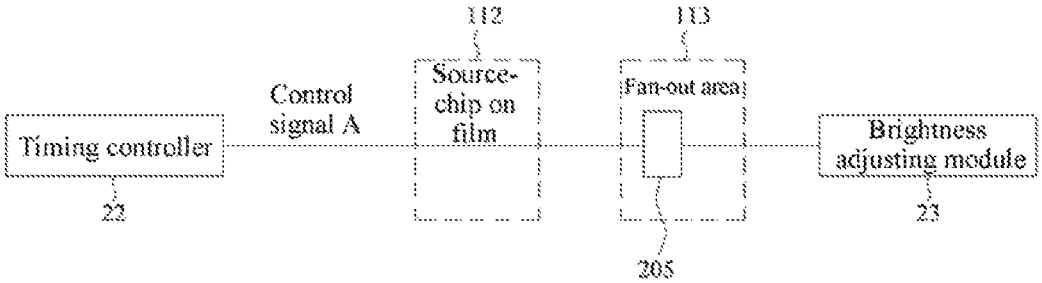
FIG. 3 is a schematic diagram of a module connection according to an embodiment of this application.
Figure 4:
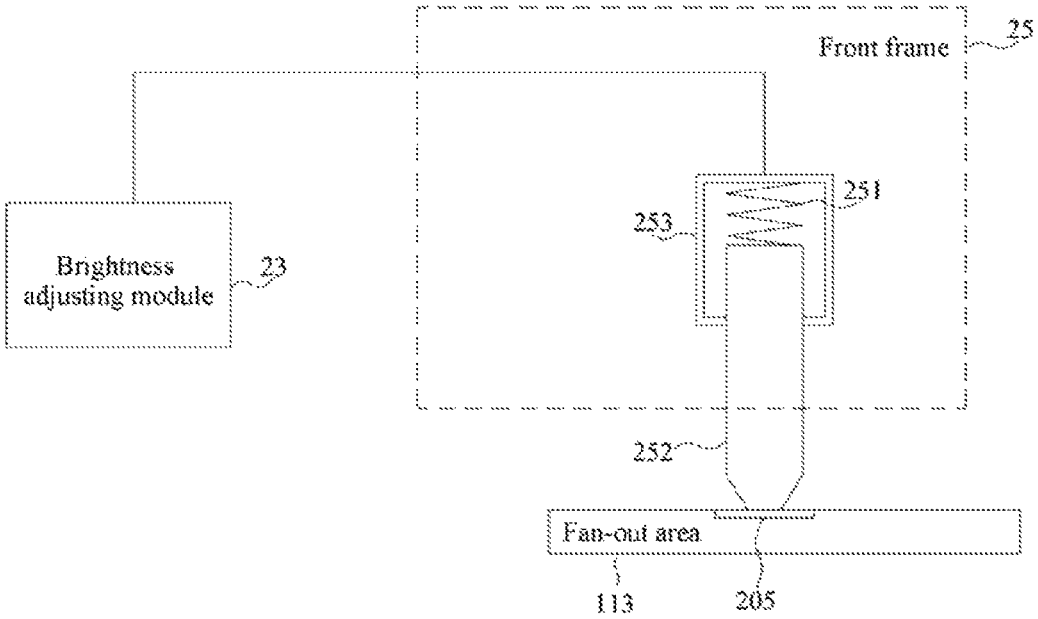
FIG. 4 is a schematic structural diagram of a module connection according to an embodiment of this application.
Figure 5:
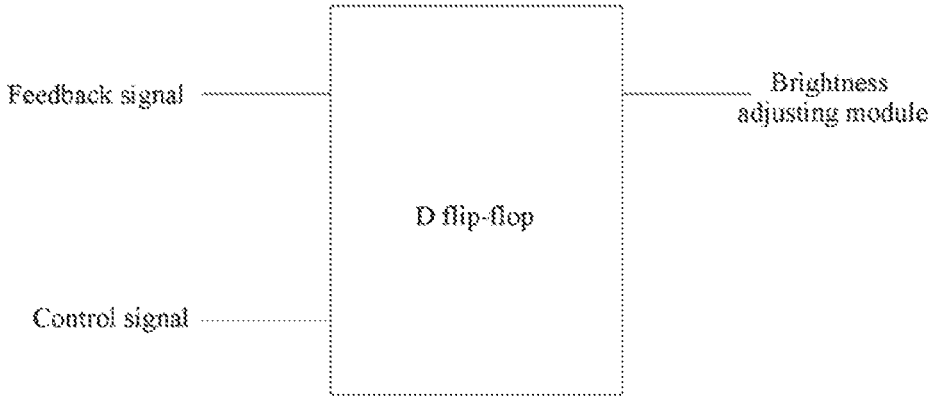
FIG. 5 is a schematic diagram of a flip-flop connection according to an embodiment of this application.

FIG. 2 is a schematic diagram of a display apparatus according to an embodiment of this application, FIG. 3 is a schematic diagram of a module connection according to an embodiment of this application, FIG. 4 is a schematic structural diagram of a module connection according to an embodiment of this application, and FIG. 5 is a schematic diagram of a flip-flop connection according to an embodiment of this application. Referring to FIG. 2 and FIG. 5, in an embodiment, a display apparatus 20 includes: a storage module 21, configured to: provide display data; a timing controller 22, configured to read the display data, convert the display data to image data, and output the image data and a control signal A; a brightness adjusting module 23, configured to: provide a light source, adjust a working state of the brightness adjusting module 23 according to the control signal A; a display module 24, configured to receive the image data output by the timing controller 22, and present a corresponding image, where after the timing controller 22 finishes configuring the image data for the display module 24 by configuring an input signal (which may be, for example, a data voltage or a scanning voltage) and reading the display data in the storage module 21, and after receiving a feedback signal B sent by the display module 24, the timing controller 22 controls the brightness adjusting module 23 to be adjusted from an initial off working state to an on working state and emit light rays to the display module 24.

In an embodiment of this application, the brightness adjusting module 23 is connected to the timing controller 22 by using a source-chip on film 112 and a fan-out area 113 (as shown in FIG. 3). The brightness adjusting module 23 is connected to a crimp area 205 (Pad area) of the fan-out area 113 by using the source-chip on film 112. Further, referring to FIG. 4 and FIG. 5, the brightness adjusting module 23 is connected to the crimp area 205 by using a wire, a spring 251, and a probe 252, so that the control signal A is transmitted to the brightness adjusting module 23. The spring 251 and a part of the probe 252 are arranged within a base 253. The base 253 is configured to fix and protect the spring 251 and the probe 252. The spring 251, the probe 252 and the base 253 are arranged in a front frame 25 of the display apparatus 20.

In an embodiment of this application, the probe 252 may be made of a metal material, and may be, for example, made of copper and a copper alloy material.

In an embodiment of this application, the brightness adjusting module 23 detects a potential status of the control signal A by using the probe 252.

In an embodiment of this application, based on different types of the display apparatus 20, the brightness adjusting module 23 may be, for example, a backlight component or an organic light emitting layer. In this embodiment, the backlight component is used as an example. However, the type of the brightness adjusting module 23 is not limited thereto.

In an embodiment of this application, potentials of the control signal A or the feedback signal B each include a high potential H and a low potential L. The control signal A or the feedback signal B may be, for example, a square wave signal, a triangular wave signal or a sine wave signal.

In an embodiment of this application, a receive end of the brightness adjusting module 23 is a rising edge-triggered D flip-flop. When the feedback signal B sent by the display module 24 is switched from the low potential L to the high potential H, the control signal A is transmitted to the brightness adjusting module 23 by the D flip-flop, and the working state of the brightness adjusting module 23 is controlled.

In an embodiment of this application, when the control signal A received by the brightness adjusting module 23 is at the high potential H, the brightness adjusting module 23 is in the on working state.

In an embodiment of this application, when the control signal A received by the brightness adjusting module 23 is at the low potential L, the brightness adjusting module 23 is in the off working state.

Figure 6:
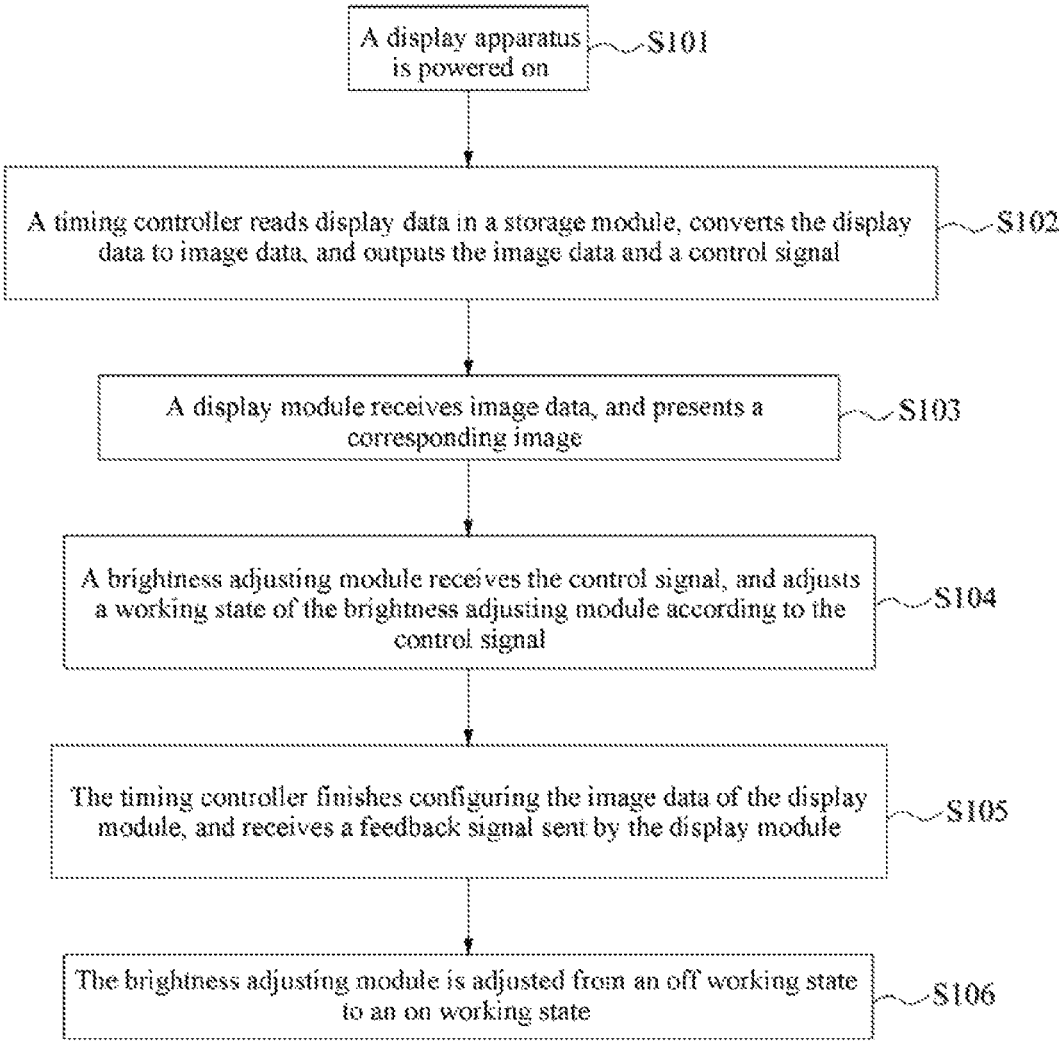
FIG. 6 is a flowchart of a method for driving a display apparatus according to an embodiment of this application.
Figure 7:
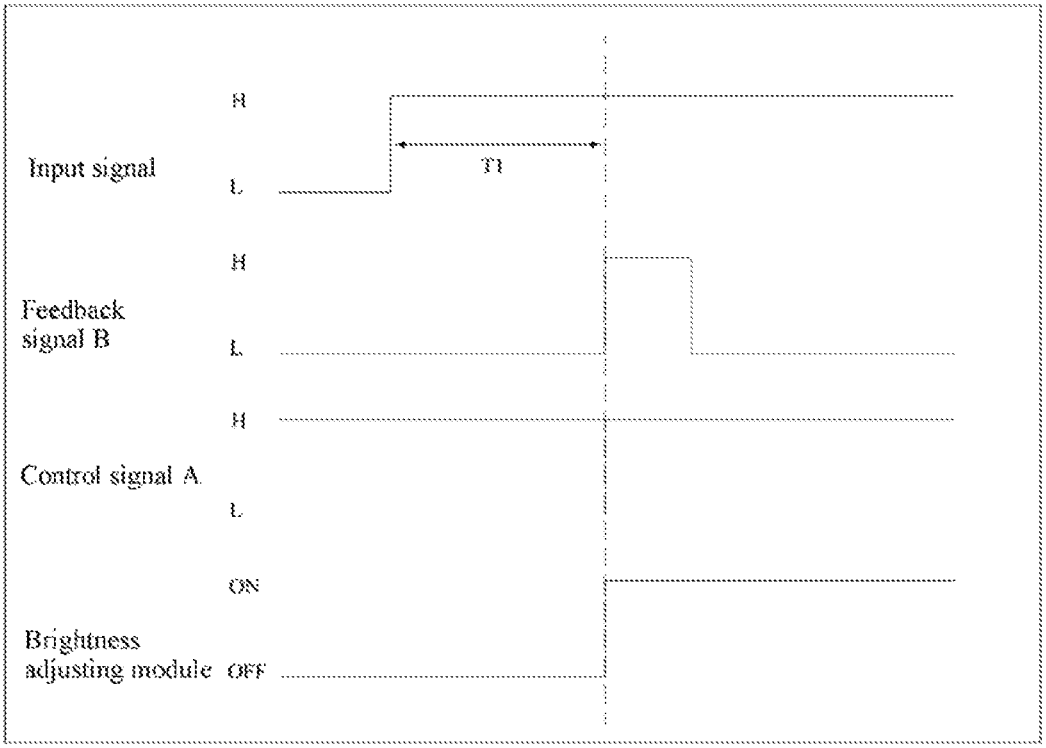
FIG. 7 is a schematic waveform graph of a display apparatus according to an embodiment of this application.

FIG. 6 is a flowchart of a method for driving a display apparatus according to an embodiment of this application; and FIG. 7 is a schematic waveform graph of a display apparatus according to an embodiment of this application. Referring to FIG. 2 to FIG. 7, in an embodiment of this application, a method for driving a display apparatus provides the display apparatus 20 described in the foregoing embodiments. The method for driving the display apparatus 20 includes: After the display apparatus 20 is powered on, where the display apparatus 20 may be, for example, turned on, the timing controller 22 reads display data in the storage module 21, converts the display data to image data for image displaying, and outputs the image data to the display module 24. The display module 24 receives the image data and presents a corresponding displayed image (where in this case, the brightness adjusting module 23 is not lightened, so that there is no light rays to the display module 24, and the "displayed image" is a working state of each element, for example, a pixel electrode, an active switch, a data line and a scanning line of the display module 24, instead of an image viewed by a viewer). After the timing controller 22 finishes configuring an input signal (which may be, for example, a data voltage or a scanning voltage) and reading the display data in the storage module 21, where a preparation time is T1 (as shown in FIG. 7), that is, the timing controller 22 finishes configuring the image data of the display module 24, the timing controller 22 receives a feedback signal B sent by the display module 24, and sends the control signal A to the brightness adjusting module 23 by using the feedback signal B. After receiving a high-potential H control signal A, the brightness adjusting module 23 is adjusted from an initial off working state OFF to an on working state ON, and provides a corresponding light source, that is, emits light rays to the display module 24. In this way, the display apparatus 20 displays a corresponding image for a viewer.

Referring to FIG. 6 and FIG. 7, the method for driving a display apparatus includes the following steps:

Step S101: The display apparatus is powered on.

Step S102: A timing controller reads display data in a storage module, converts the display data to image data, and outputs the image data and a control signal.

Step S103: A display module receives image data, and presents a corresponding image.

Step S104: A brightness adjusting module receives the control signal, and adjusts a working state of the brightness adjusting module according to the control signal.

Step S105: The timing controller finishes configuring the image data of the display module, and receives a feedback signal sent by the display module.

Step S106: The brightness adjusting module is adjusted from an off working state to an on working state.

In an embodiment of this application, the brightness adjusting module 23 receives the control signal A, and the working state of the brightness adjusting module 23 is adjusted according to a potential of the control signal A.

In an embodiment of this application, the potential of the control signal A includes a high potential H and a low potential L, where a high-potential H control signal A may be, for example, a high-potential H square wave signal, a high-potential H triangular wave signal or a high-potential H sine wave signal.

In an embodiment of this application, when the control signal A received by the brightness adjusting module 23 is at the high potential H, the brightness adjusting module 23 is in the on working state.

In an embodiment of this application, when the control signal A received by the brightness adjusting module 23 is at the low potential L, the brightness adjusting module 23 is in the off working state.

In some embodiments, by using the apparatus and method in the foregoing embodiments, the brightness adjusting module 23 is turned on after preparations of the display module 24 are finished. This can ensure that an abnormal image caused by abnormality of the timing controller 22 is not viewed by a viewer.

In some embodiments, during actual application, the control signal A may be maintained at a high-potential H all the time. When a D flip-flop receives a rising edge of the feedback signal B, the high potential H of the control signal A is transmitted to the brightness adjusting module 23, causing the brightness adjusting module 23 to be in the ON state.

In some embodiments, the display apparatus 20 of this application includes a display panel. In the foregoing embodiments, the display panel may be equivalent to the display module 24. The display panel may be, for example, a liquid crystal display panel, but is not limited thereto. The display panel may alternatively be an OLED display panel, a W-OLED display panel, a QLED display panel, a plasma display panel, a curved surface type display panel, or a display panel of another type.

By using the design of the display apparatus and the driving method therefor of this application, it can be ensured that the brightness adjusting module 23 is turned on after preparations of the timing controller 22 are finished. This can prevent, when abnormality occurs, an abnormal image from being viewed by a viewer due to that a preparation time of the timing controller 22 is longer than a preset value. In this way, a structure of the display apparatus is optimized and viewer experience is improved.

The wordings such as "in some embodiments" and "in various embodiments" are repeatedly used. The wordings usually refer to different embodiments, but they may also refer to a same embodiment. The words, such as "comprise", "have", and "include", are synonyms, unless other meanings are indicated in the context thereof.

The foregoing descriptions are merely embodiments of this application, and are not intended to limit this application in any form. Although this application has been disclosed above through the specific embodiments, the embodiments are not intended to limit this application. Any person skilled in the art can make some variations or modifications, which are equivalent changes, according to the foregoing disclosed technical content to obtain equivalent embodiments without departing from the scope of the technical solutions of this application. Any simple amendment, equivalent change, or modification made to the foregoing embodiments according to the technical essence of this application without departing from the content of the technical solutions of this application shall fall within the scope of the technical solutions of this application.

What is claimed is:

1. A display apparatus, comprising:

a storage module provide display data;

a timing controller read the display data, convert the display data to image data, and output the image data and a control signal;

a brightness adjusting module adjust a working state of the brightness adjusting module according to the control signal; and a display module receive the image data output by the timing controller and present a corresponding image, wherein after finishing configuring the image data of the display module and receiving a feedback signal sent by the display module, the timing controller controls the brightness adjusting module to be adjusted from an off working state to an on working state; and the brightness adjusting module is connected to the timing controller by using a spring and a probe of a fan-out area.

2. The display apparatus according to claim 1, wherein the spring and a part of the probe are arranged within a base.

3. The display apparatus according to claim 2, wherein the spring, the probe and the base are arranged in a front frame of the display apparatus.

4. The display apparatus according to claim 1, wherein the brightness adjusting module detects a potential status of the control signal by using the probe.

5. The display apparatus according to claim 1, wherein potentials of the control signal and potentials of the feedback signal each comprise a high potential and a low potential.

6. The display apparatus according to claim 5, wherein the control signal or the feedback signal is a square wave signal.

7. The display apparatus according to claim 5, wherein the control signal or the feedback signal is a triangular wave signal.

8. The display apparatus according to claim 5, wherein the control signal or the feedback signal is a sine wave signal.

9. The display apparatus according to claim 5, wherein when the control signal received by the brightness adjusting module is at a high potential, the brightness adjusting module is in the on working state.

10. The display apparatus according to claim 5, wherein when the control signal received by the brightness adjusting module is at a low potential, the brightness adjusting module is in the off working state.

11. The display apparatus according to claim 1, wherein the probe is made of a metal material.

12. The display apparatus according to claim 11, wherein the probe is made of copper and a copper alloy material.

13. A method for driving a display apparatus, comprising:

powering on the display apparatus;

reading, by a timing controller, display data in a storage module, converting the display data to image data, and outputting the image data and a control signal;

receiving, by a display module, the image data, and presenting a corresponding image;

receiving, by a brightness adjusting module, the control signal, and adjusting a working state of the brightness adjusting module according to the control signal; and after finishing configuring the image data of the display module and receiving a feedback signal sent by the display module, controlling, by the timing controller, the brightness adjusting module to be adjusted from an off working state to an on working state.

14. The method for driving a display apparatus according to claim 13, wherein potentials of the control signal and potentials of the feedback signal each comprise a high potential and a low potential.

15. The display apparatus according to claim 14, wherein the control signal or the feedback signal are square wave signals.

16. The method for driving a display apparatus according to claim 14, wherein the control signal or the feedback signal is a triangular wave signal.

17. The method for driving a display apparatus according to claim 14, wherein the control signal or the feedback signal is a sine wave signal.

18. The method for driving a display apparatus according to claim 14, wherein when the control signal received by the brightness adjusting module is at a high potential, the brightness adjusting module is in the on working state.

19. The method for driving a display apparatus according to claim 14, wherein when the control signal received by the brightness adjusting module is at a low potential, the brightness adjusting module is in the off working state.

20. A display apparatus, comprising:

a storage module provide display data;

a timing controller read the display data, convert the display data to image data, and output the image data and a control signal, wherein potentials of the control signal and potentials of the feedback signal each comprise a high potential and a low potential, and the control signal and the feedback signal are square wave signals;

a brightness adjusting module adjust a working state of the brightness adjusting module according to the control signal;

a display module receive the image data output by the timing controller and present a corresponding image, wherein the brightness adjusting module is connected to the timing controller by using a spring and a probe of a fan-out area, the spring and a part of the probe are arranged within a base, wherein the spring, the probe and the base are arranged in a front frame of the display apparatus;

the brightness adjusting module detects a potential status of the control signal by using the probe; and after finishing configuring the image data of the display module and receiving a feedback signal sent by the display module, the timing controller outputs a high-potential square wave signal to the brightness adjusting module by using a source-chip on film and a fan-out area, and controls the brightness adjusting module to be adjusted from an off working state to an on working state.

* * * * *